US010682542B2

(12) United States Patent
Thorpe

(10) Patent No.: US 10,682,542 B2
(45) Date of Patent: Jun. 16, 2020

(54) ATHLETIC TRAINING APPARATUS TO FACILITATE A HAMSTRING MUSCLE STRETCH

(71) Applicant: Michael J Thorpe, Huntington Beach, CA (US)

(72) Inventor: Michael J Thorpe, Huntington Beach, CA (US)

( * ) Notice: Subject to any disclaimer, the term of this patent is extended or adjusted under 35 U.S.C. 154(b) by 23 days.

(21) Appl. No.: 16/129,590

(22) Filed: Sep. 12, 2018

(65) Prior Publication Data

US 2019/0076692 A1 Mar. 14, 2019

Related U.S. Application Data

(60) Provisional application No. 62/558,212, filed on Sep. 13, 2017.

(51) Int. Cl.
*A63B 21/00* (2006.01)
*A63B 23/035* (2006.01)
(Continued)

(52) U.S. Cl.
CPC ..... *A63B 21/154* (2013.01); *A63B 1/00* (2013.01); *A63B 21/00185* (2013.01); *A63B 21/4015* (2015.10); *A63B 23/03508* (2013.01); *A63B 23/04* (2013.01); *A63B 2023/006* (2013.01); *A63B 2208/0252* (2013.01); *A63B 2210/58* (2013.01); *A63B 2225/09* (2013.01)

(58) Field of Classification Search
CPC ..... A63B 21/00185; A63B 21/068; A63B 21/154; A63B 21/159; A63B 23/0482; A63B 2023/006; A61H 1/0237–0259
See application file for complete search history.

(56) References Cited

U.S. PATENT DOCUMENTS 4,669,450 A * 6/1987 Lindberg ..... A61H 1/0266 482/80
5,067,709 A 11/1991 Christjanson
(Continued)

FOREIGN PATENT DOCUMENTS

WO WO-2017066828 A1 * 4/2017 ..... A61H 1/0237

OTHER PUBLICATIONS http://web.archive.org/web/20160315090304/http://www.technogym.com:80/gb/posterior-wood-flexability.html, Mar. 15, 2016, Technogym Spa.

(Continued)

*Primary Examiner* — Jennifer Robertson
(74) *Attorney, Agent, or Firm* — Plager Schack LLP; Mark H. Plager

(57) ABSTRACT

An athletic training apparatus for use to facilitate a stretch of a hamstring muscle of a user in a supine position is provided. The training apparatus helps to maintain a neutral spine of the user and prevent posterior pelvic tilt during the stretch. The athletic training apparatus includes a strap having a first end portion with a loop designed to engage the user's foot and a second end portion designed to engage the user's hand, and a strut having a first end slidably mounted to the strap and a second end designed to contact the user's hip region. A pulling force applied to the second end portion of the strap permits the loop of the strap to raise the foot to a generally upright position, thereby stretching the user's hamstring muscle.

12 Claims, 8 Drawing Sheets

(51) Int. Cl.

| | |
|---|---|
| ***A63B 23/04*** | (2006.01) |
| ***A63B 1/00*** | (2006.01) |
| ***A63B 23/00*** | (2006.01) |

(56) References Cited

U.S. PATENT DOCUMENTS

| | | | | |
|---|---|---|---|---|
| 5,122,106 | A | 6/1992 | Atwood et al. | |
| 5,595,559 | A * | 1/1997 | Viel | A61H 1/0237 482/114 |
| 5,634,873 | A * | 6/1997 | Carlstrom | A63B 21/154 482/142 |
| 5,984,845 | A | 11/1999 | Powers | |
| 6,203,473 | B1 | 3/2001 | Atwood | |
| 6,338,700 | B1 * | 1/2002 | Pollock | A63B 21/154 482/904 |
| 6,368,255 | B1 | 4/2002 | Chan-Rouse | |
| 6,634,995 | B1 | 10/2003 | Reed | |
| 7,223,212 | B2 | 5/2007 | DiOrio et al. | |
| 7,309,305 | B2 | 12/2007 | Nichols | |
| 7,476,182 | B2 | 1/2009 | DeNisco | |
| 7,946,971 | B2 | 5/2011 | Conley et al. | |
| 8,025,617 | B2 | 9/2011 | Tennant et al. | |
| 8,092,354 | B2 | 1/2012 | Oller, Jr. | |
| 8,398,530 | B1 * | 3/2013 | Rubens | A63B 21/00185 482/131 |
| 10,463,910 | B1 * | 11/2019 | Nakhimovsky | A63B 23/00 |
| 2007/0070817 | A1 | 3/2007 | Fluegge | |
| 2007/0111865 | A1 * | 5/2007 | Patton | A63B 21/0004 482/91 |
| 2007/0161480 | A1 | 7/2007 | Trancart et al. | |
| 2010/0234192 | A1 * | 9/2010 | Oller, Jr. | A63B 21/00047 482/131 |
| 2012/0040808 | A1 | 2/2012 | Khademi | |
| 2013/0197403 | A1 * | 8/2013 | Sevy | A63B 21/0442 601/5 |
| 2014/0018216 | A1 | 1/2014 | Hatfield | |
| 2014/0073998 | A1 * | 3/2014 | Keiser | A63B 21/00185 601/34 |
| 2015/0148199 | A1 | 5/2015 | Strickland et al. | |
| 2016/0236031 | A1 * | 8/2016 | Nouri | A63B 21/151 |
| 2019/0321682 | A1 * | 10/2019 | Davies, III | A63B 21/4035 |

OTHER PUBLICATIONS http://web.archive. org/web/20170803210032/http://www.medi-dyne.com:80/estore/corestretch-brand/corestretch, Aug. 3, 2017, CoreStretch.

* cited by examiner

ATHLETIC TRAINING APPARATUS TO FACILITATE A HAMSTRING MUSCLE STRETCH

RELATED APPLICATION

The application claims priority to provisional patent application U.S. Ser. No. 62/558,212 filed on Sep. 13, 2017, the entire contents of which is herein incorporated by reference.

BACKGROUND

The embodiments herein relate generally to workout and exercise devices. More specifically, embodiments of the invention relate to an athletic training apparatus configured to help users to stretch their hamstring muscles.

The majority of people will experience back pain in their lifetime. Tight hamstrings are widely regarded a risk factor for low back injury. Most people fail to improve their flexibility because they are not relaxed when stretching or do not hold their stretch long enough. This leads to poor stretching compliance. Performing a safe, comfortable and effective hamstring stretch can be challenging for many individuals. For example, certain large or muscular individuals with tight muscles have a difficult time stretching their hamstrings, even with the help of clinicians or support staff. Flexible individuals such as dancers, gymnasts, martial artists and other athletes are often too flexible in certain body areas, which makes it difficult for them to focus a stretch on the hamstring alone. As such, many individuals can benefit from the use of a hamstring stretching tool.

A wide variety of exercise and stretching devices exist to stretch the user's muscles such as yoga straps and devices disclosed in U.S. Pat. Nos. 5,067,709, 5,634,873, 5,984,845, 6,203,473, 6,338,700, 6,368,255, 6,634,995, 7,223,212, 7,309,305, 7,476,182, 7,946,971, 8,025,617 and 8,092,354, and U.S. Patent Application Publications 2007/0070817, 2007/0161480, 2012/0040808, 2014/0018216 and 2015/0148199. Other stretching devices on the market exist such as Technogym's FLEXABILITY Posterior device and Medi-dyne's CoreStretch device.

However, these devices have limitations and/or are not practical for use by everyone. Specifically, yoga straps and other similar devices used to assist a person in stretching his/her hamstrings are not well adapted for use with individuals with very tight muscles. Further these straps do not provide enough mechanical advantage to reduce user effort during the stretch. If a person with inflexible hamstrings uses a strap to stretch his/her hamstrings, the pull of the strap is not oriented in a direction to maximize its effect. This makes for an inefficient stretch, less relaxation, more effort, and therefore worse stretching and compliance.

Other exercise and stretching devices are limited because (1) the devices require the use of complicated and/or bulky components; (2) the device requires the attachment of certain components such as a pulley to a wall, door or other flat surface, thereby limiting the number of locations available to use the device; and/or (3) the device does not provide a counterforce at the user's hip region during the stretch to maintain a neutral spine and prevent posterior pelvic tilt. The use of these exercise and stretching devices may also be problematic due to one or more of the following: (1) the device stretches both hamstrings at the same time, which can cause back pain as the pelvis tilts posteriorly and the lower back stretches into flexion; (2) the device forces knee extension, which may exacerbate sciatic nerve irritation; (3) the device forces ankle dorsiflexion, which may exacerbate sciatic nerve irritation; and/or (4) the device does not provide sufficient leverage, which may cause arm or neck strain due to excessive effort.

As such, there is a need in the industry for an athletic training apparatus that helps users to stretch their hamstring muscles, which overcomes the limitations of the prior art. In particular, there is a need for the athletic training apparatus to have the following characteristics and advantages: (1) simple to use; (2) affordable; (3) portable; (4) hand-held; (5) requires no fixation on a table, surface, door or wall; (6) provides a counter force at the user's hip region; (7) provides excellent mechanical advantage to allow for a comfortable and sustained stretch; (8) facilitates a unilateral stretch that minimizes strain to the lower back; (9) allows the knee to be flexed during the stretch if needed to protect a tight sciatic nerve; (10) allows the foot to be plantar flexed to protect a tight sciatic nerve; and (11) provides adjustability to accommodate different-sized individuals.

SUMMARY

An athletic training apparatus for use to facilitate a stretch of a hamstring muscle of a user in a supine position with reduced effort is provided. The training apparatus is configured to engage with a foot, hand and hip region of the user and apply a counterforce at the hip region during the stretch to maintain a neutral spine of the user and prevent posterior pelvic tilt. The athletic training apparatus comprises a strap comprising a first end portion and a second end portion, the first end portion of the strap comprising a loop configured to engage the foot of the user, the second end portion of the strap configured to engage the hand of the user, and a strut comprising a first end slidably mounted to an intermediate portion of the strap and a second end configured to contact the hip region of the user, wherein the apparatus is maneuvered to an operational position with the first and second end portions of the strap configured to engage the foot and hand and the second end of the strut configured to contact the hip region of the user when in the supine position, wherein a pulling force applied to the second end portion of the strap permits the loop of the strap to raise the foot to a generally upright position, thereby stretching the hamstring muscle of the user, wherein the second end of the strut is configured to apply the counterforce to the hip region of the user during application of the pulling force at the second end portion of the strap to maintain the neutral spine of the user.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
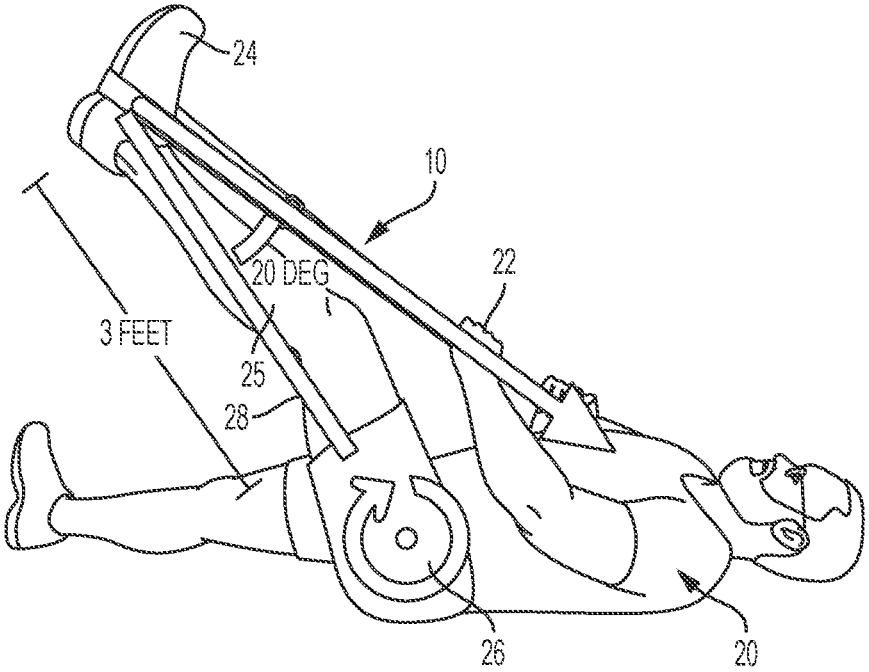
FIG. 1 PRIOR ART
FIG. 1 depicts a side view of a training apparatus in the prior art shown in use.

FIG. 1 depicts training apparatus 10 shown in use. Training apparatus 10 comprises a conventional yoga strap or similar-type device known in the prior art. Training apparatus 10 is commonly used by user 20 to perform a stretch of a muscle such as hamstring muscle 28. Training apparatus 10 comprises a strap with one or more rings or fastening members. User 20 in a stable supine position on the ground engages a loop portion in training apparatus 10 with foot 24 and pulls on an end of the strap with hand 22. This pulling motion pivots leg 25 of user 20 to a generally upright position to stretch hamstring muscle 28.

As previously discussed, training apparatus 10 does not provide enough mechanical advantage to reduce user effort during the stretch and fails to apply a counterforce at hip portion 26 of user 20. As a result, the use of training apparatus 10 to stretch hamstring muscle 28 may subject user 20 to a misaligned spine, posterior pelvic tilt and/or injury.

Figure 2A:
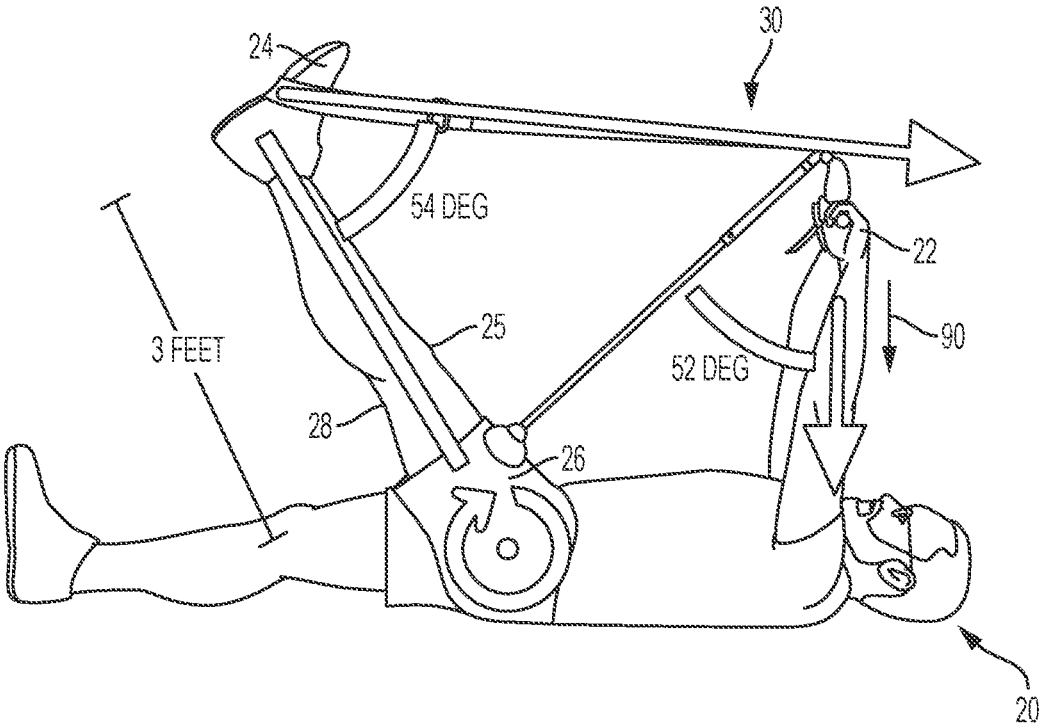
FIG. 2A depicts a side view of certain embodiments of the athletic training apparatus shown in use.
Figure 2B:
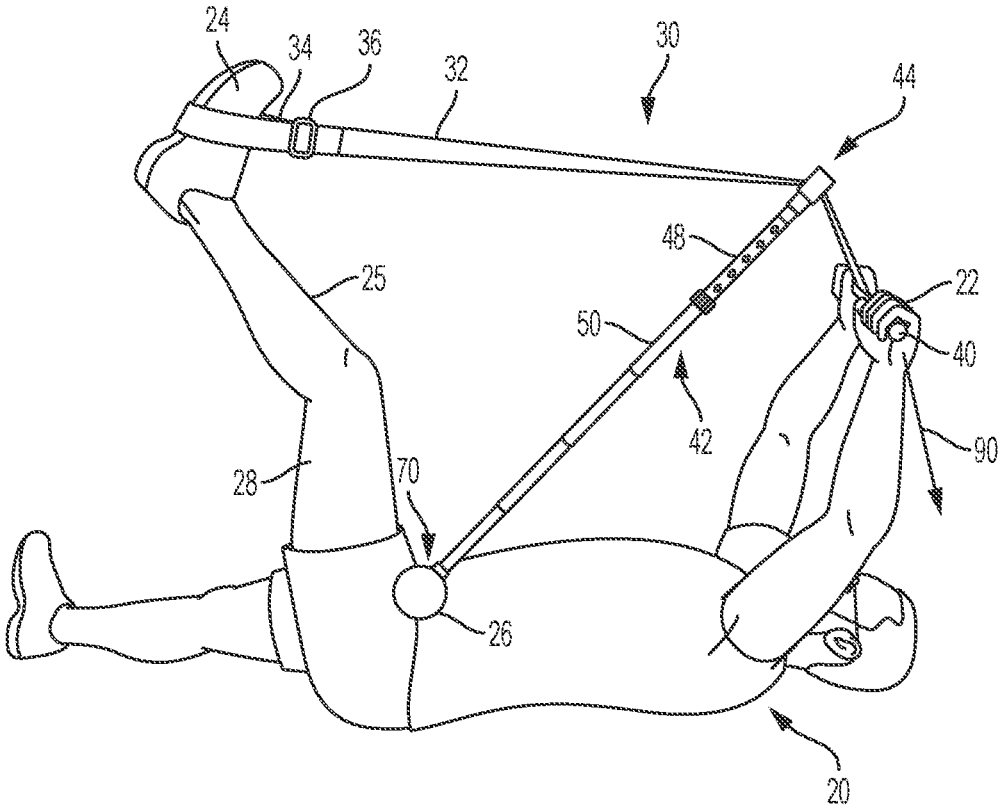
FIG. 2B depicts a side view of certain embodiments of the athletic training apparatus shown in use.
Figure 3:
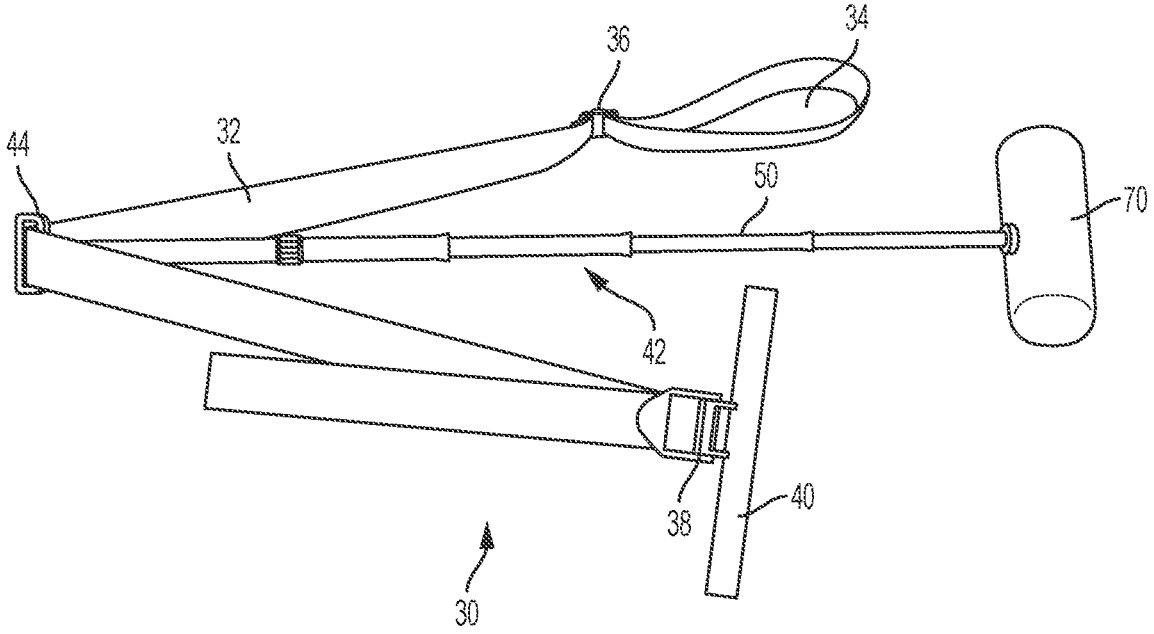
FIG. 3 depicts a perspective view of certain embodiments of the athletic training apparatus.

As depicted in FIGS. 2-3, athletic training apparatus 30 is configured for use by user 20 to facilitate a stretch of hamstring muscle 28. As depicted in FIGS. 2A-2B, user 20 maneuvers athletic training apparatus 30 when in a stable supine position on the ground. Athletic training apparatus 30 provides sufficient mechanical advantage to reduce user effort during the stretch and applies a counterforce to hip portion 26 of user 20 to help maintain a neutral spine. In certain embodiments of the invention, athletic training apparatus generally comprises strap 32, strut 42 and pad member 70.

In one embodiment, strap 32 is made from webbing and is approximately 5'-7' in length and 2" in width. However strap 32 may have variable dimensions and be made from alternative materials known in the field. As depicted in FIGS. 2-3, loop slide fastener 36 is slidably mounted to strap 32. Loop slide fastener 36 comprises multiple slots configured to permit strap 32 to pass therethrough. Strap 32 inserts through the slots in loop slide fastener 36 to form loop 34 in strap 32. Strap 32 can slidably adjust through loop slide fastener 36 to vary the size of loop 34 as desired.

In one embodiment, handle 40 is coupled to handle slide fastener 38, which slidably adjusts along strap 32. Strap 32 can be slidably adjusted relative to handle slide fastener 38 to position handle 40 in the desired location along strap 32. Handle 40 can be made from any materials including, but not limited to, rubber, plastic, metal, wood or other materials.

Figure 4:
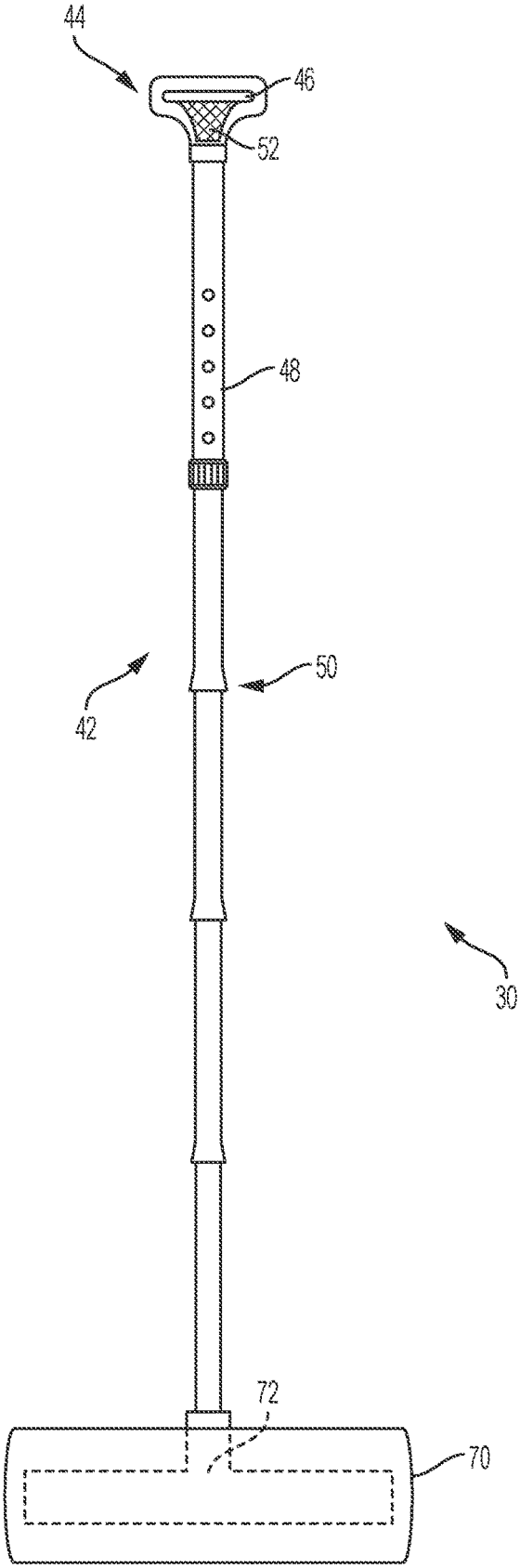
FIG. 4 depicts a top view of certain embodiments of the athletic training apparatus.

As depicted in FIGS. 2-4, strut 42 is configured to attach to strap 32. In one embodiment, strut 42 comprises a generally rigid elongated rod preferably made from steel. In one embodiment, strut 42 is configured to support a load of up to 300 lb. However, strut 42 may be made from other metals or materials in alternative embodiments. In one embodiment, strut 42 comprises collapsible portion 50 and length adjustment mechanism 48 to adjust the length of the rod.

Collapsible portion 50 of strut 42 comprises a plurality of telescopic tubular members connected together. The telescopic tubular members extend or retract relative to each other to lengthen or shorten collapsible portion 50 of strut 42. In one embodiment, length adjustment mechanism 48 comprises a pair of telescoping members that can extend or retract relative to each other to vary the length. In one embodiment, length adjustment mechanism 48 comprises a locking device such as a pin that engages with one of a plurality of openings disposed along one of the pair of telescoping members. The pin engages with the one of the plurality of openings to secure the pair of telescoping members of length adjustment mechanism 48 in the desired length. In one embodiment, strut 42 is approximately 34" in length. In one embodiment, the length of strut 42 can adjust within the approximate range of 28"-40". In an alternative embodiment, strut 42 is formed entirely by collapsible members or telescoping members. In an alternative embodiment, strut 42 can be a fixed, non-adjustable bar member.

Figure 5:
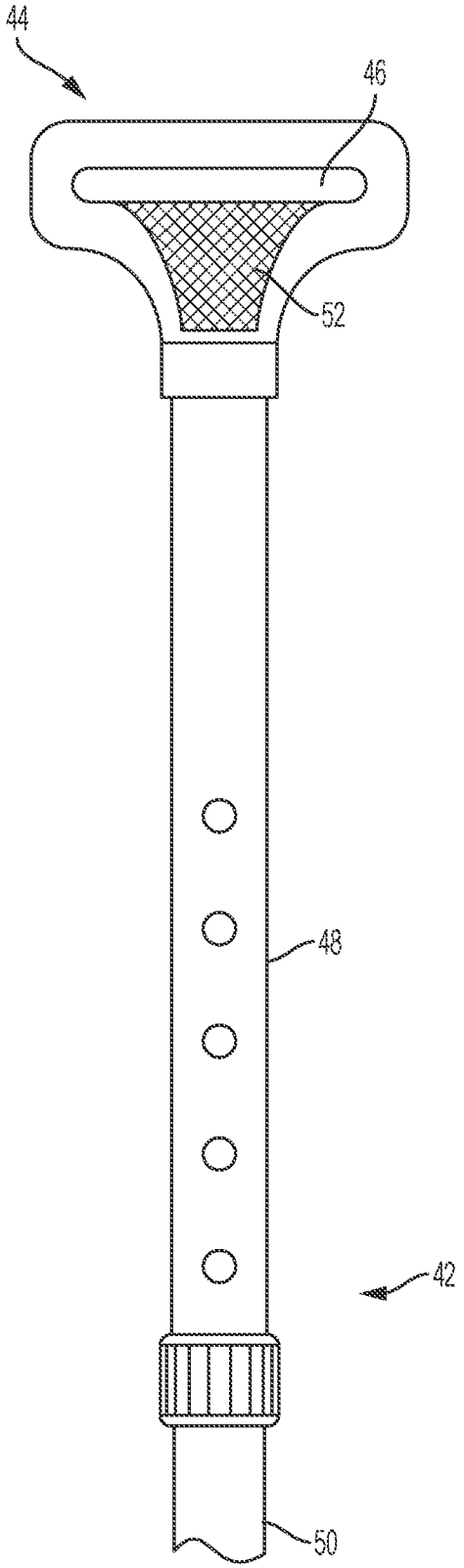
FIG. 5 depicts a top view of certain embodiments of the athletic training apparatus.
Figure 9:
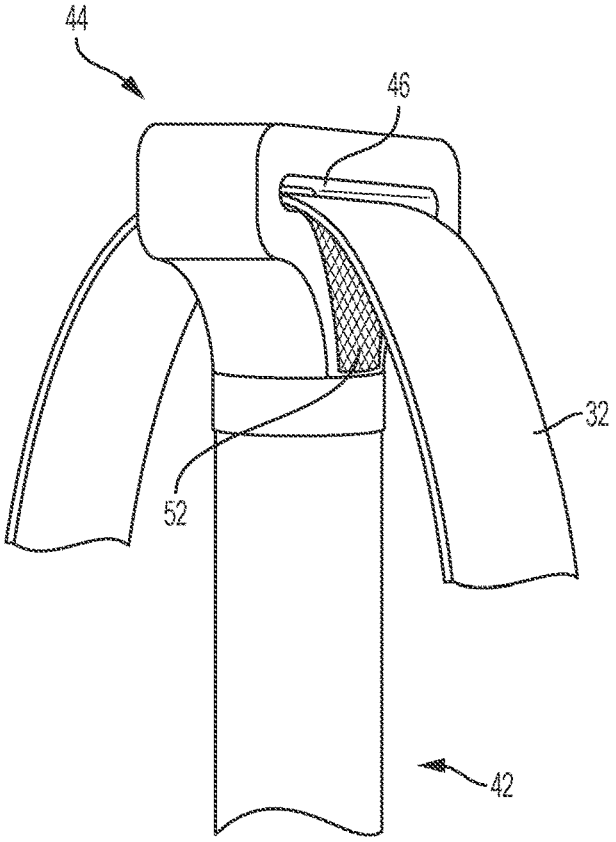
FIG. 9 depicts a perspective view of certain embodiments of the athletic training apparatus illustrating strut connection member 44.
Figure 10:
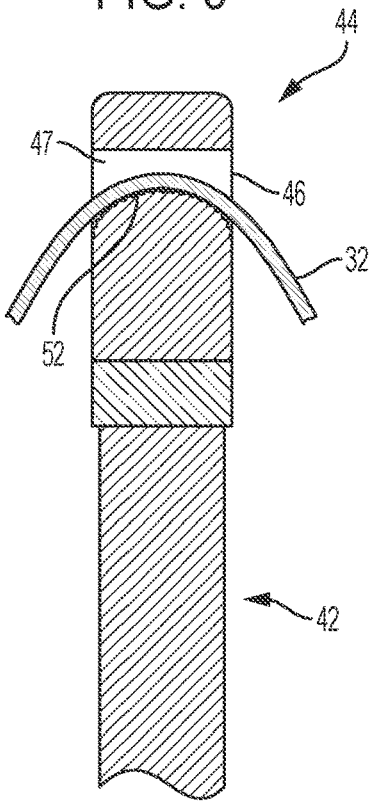
FIG. 10 depicts a cross-sectional view of certain embodiments of the athletic training apparatus illustrating strut connection member 44.
Figure 11:
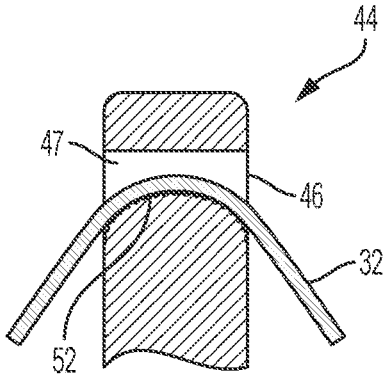
FIG. 11 depicts a cross-sectional view of certain embodiments of the athletic training apparatus illustrating strut connection member 44.

As depicted in FIGS. 4-5, a first end of strut 42 is coupled to strut connection member 44. Strut connection member 44 comprises slot 46 and a friction member such as anti-slip tape 52 used on vehicles such as skateboards. Slot 46 permits strap 32 to pass therethrough. As depicted in FIGS. 9-11, anti-slip tape 52 is disposed on the interior wall of slot 46 and is configured to contact strap 32. A friction member such as anti-slip tape 52 should provide sufficient friction that prevents strap 32 from freely slipping through pathway 47 of slot 46 when under load during the performance of a hamstring stretch. In addition, anti-slip tape 52 should have sufficient resistance to slip to permit strap 32 to slide through slot 46 of strut connection member 44 easily when not under load. This is important for adjustment purposes to permit athletic training apparatus 30 to accommodate different users.

It shall be appreciated that strut connection member 44 can be modified to use different friction members to interact with strap 32 having any variety of materials, grip members and structural features. In certain embodiments, pathway 47 in slot 46 of strut connection member 44 comprises a linear shape, generally V-shape, generally U-shape or alternative shape.

Figure 12:
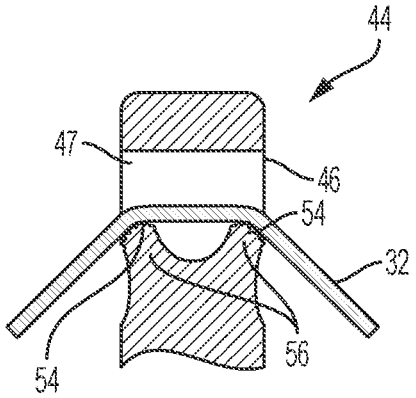
FIG. 12 depicts a cross-sectional view of an alternative embodiment of the athletic training apparatus illustrating strut connection member 44.
Figure 13:
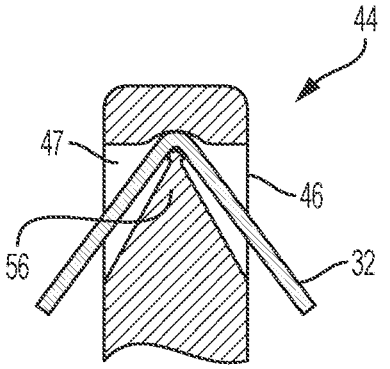
FIG. 13 depicts a cross-sectional view of an alternative embodiment of the athletic training apparatus illustrating strut connection member 44.
Figure 14:
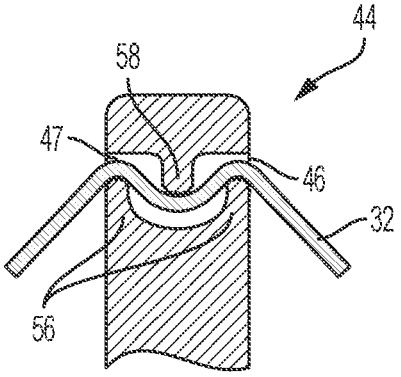
FIG. 14 depicts a cross-sectional view of an alternative embodiment of the athletic training apparatus illustrating strut connection member 44.

FIGS. 12-16 depict strut connection member 44 in alternative embodiments illustrating various friction members and pathways 47. FIG. 12 depicts strut connection member 44 with teeth 54 and ridges 56 in pathway 47 in one embodiment. FIG. 13 depicts strut connection member 44 with ridge 56 in pathway 47 in one embodiment. FIG. 14 depicts strut connection member 44 with ridges 56 and protrusion 58 in pathway 47 in one embodiment.

Figure 15:
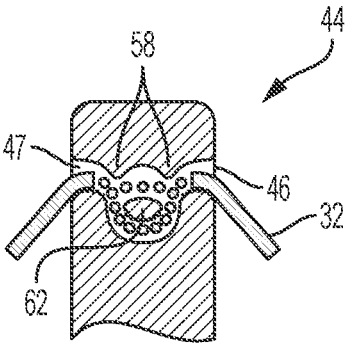
FIG. 15 depicts a cross-sectional view of an alternative embodiment of the athletic training apparatus illustrating strut connection member 44.
Figure 16:
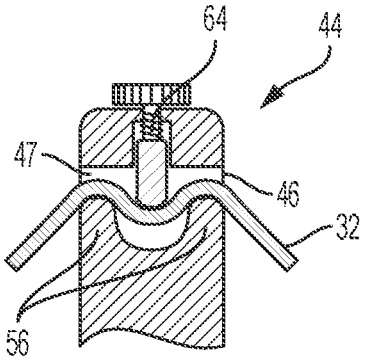
FIG. 16 depicts a cross-sectional view of an alternative embodiment of the athletic training apparatus illustrating strut connection member 44.

FIG. 15 depicts strut connection member 44 with interior divider 62 in pathway 47. In this embodiment, strap 32 can extend in a first pathway above interior divider 62 or a second pathway below interior divider 62 as desired. FIG. 16 depicts strut connection member 44 with screw assembly 64 and ridges 56 in pathway 47 in one embodiment. In this embodiment, screw assembly 64 can be rotatably adjusted as desired to vary the force applied to strap 32. This allows the user to gradually increase or decrease the friction applied to strap 32 as desired. It shall be appreciated that the type of strut connection member 44 used with strut 42 can be selected based on user and manufacturing requirements.

Figure 6:
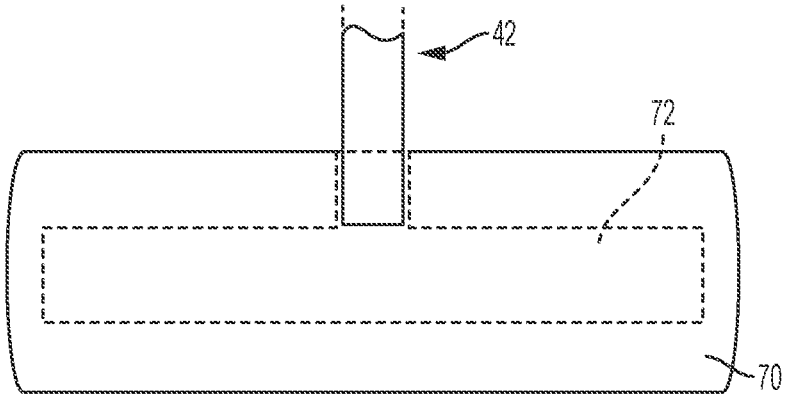
FIG. 6 depicts a top view of certain embodiments of the athletic training apparatus illustrating pad member 70.

As depicted in FIGS. 3-4 and 6, the second end of strut 42 is coupled to pad member 70, which is configured to contact hip portion 26 of user 20. In a preferred embodiment, pad member 70 is rotatably mounted to strut 42 by internal connector member 72. Internal connector member 72 is a tubular generally T-shaped pipe made from PVC, metal or other material. Internal connector member 72 is disposed within pad member 70 so that a protruding portion extends outside pad member 70. The protruding portion of internal connector member 72 engages with the second end of strut 42 using any type of threaded connection or swivel joint known in the field. In a preferred embodiment, pad member 70 is configured to rotate clockwise within the approximate range of 15 degrees to 360 degrees and counterclockwise within the approximate range of 15 degrees to 360 degrees relative to strut 42.

Figure 7:
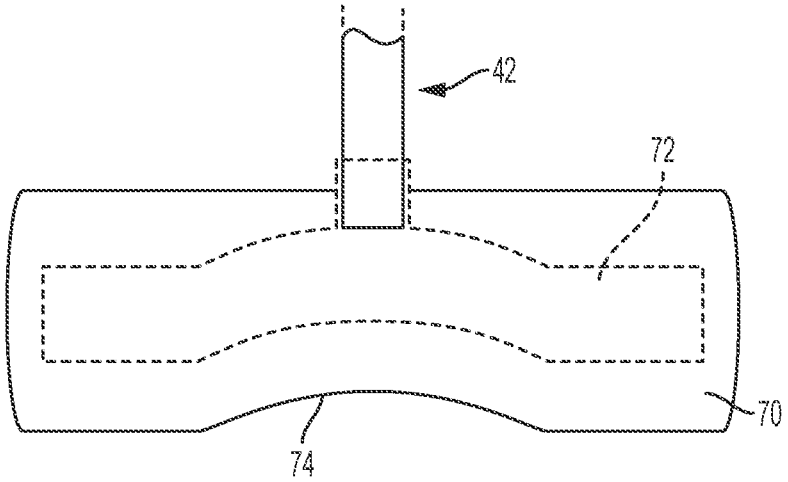
FIG. 7 depicts a top view of an alternative embodiment of the athletic training apparatus illustrating pad member 70.
Figure 8:
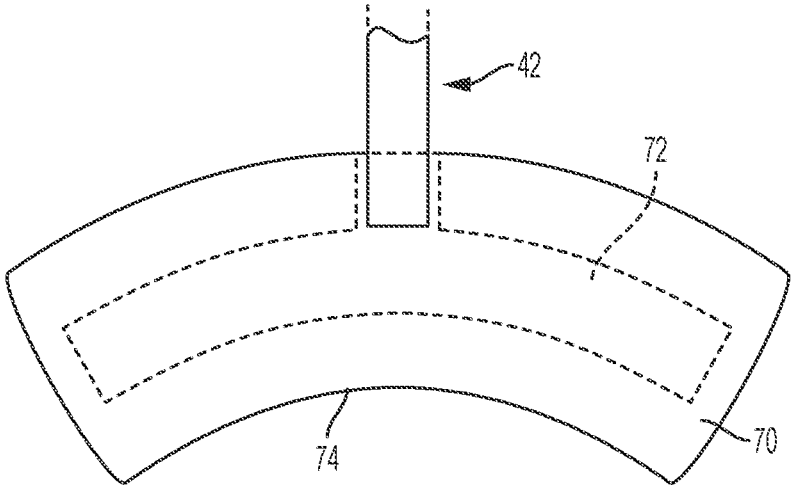
FIG. 8 depicts a top view of an alternative embodiment of the athletic training apparatus illustrating pad member 70.

Pad member 70 is made from any resilient and deformable cushion member made from foam or other similar-type material. In certain embodiments, internal connector member 72 comprises variable shapes to accommodate pad member 70 with a bottom concave surface 74 as depicted in FIGS. 7-8. Bottom concave surface 74 is configured to conform to hip portion 26 of user 20.

In operation, athletic training apparatus 30 is adjusted to accommodate user 20 in a stable supine position on the ground or alternative flat surface as depicted in FIG. 2. Strap 32 is adjusted to permit loop 34 to engage with foot 24 of user 20. Pad member 70 is positioned on hip portion 26 of user 20. One or both hands 22 of user 20 engage handle 40 to maneuver strap 32 within slot 46 and pathway 47 of strut connection member 44. User 20 applies pulling force 90 on handle 40 in a generally downward direction when strap 32 is in contact with anti-slip tape 52 or alternative friction member in strut connection member 44. This pulling force enables loop 34 of strap 32 to pivotably adjust foot 24 and leg 25 to a generally upright position. In this position, athletic training apparatus 30 stretches hamstring muscle 28 of user 20. During this stretch, strut 42 and pad member 70 apply a counterforce to hip portion 26 of user 20. This counterforce helps to maintain the spine of user 20 in a neutrally aligned position and prevents posterior pelvic tilt.

Athletic training apparatus 30 is advantageous because it provides sufficient mechanical advantage to reduce the user effort necessary to facilitate a hamstring stretch. Athletic training apparatus 30 permits the user to comfortably perform a hamstring stretch for a longer period of time while reducing the likelihood the user suffers an injury. Ultimately, athletic training apparatus 30 provides a portable and handheld solution that the user can use to perform a hamstring stretch without the help of a clinician or other individual.

Figure 17:
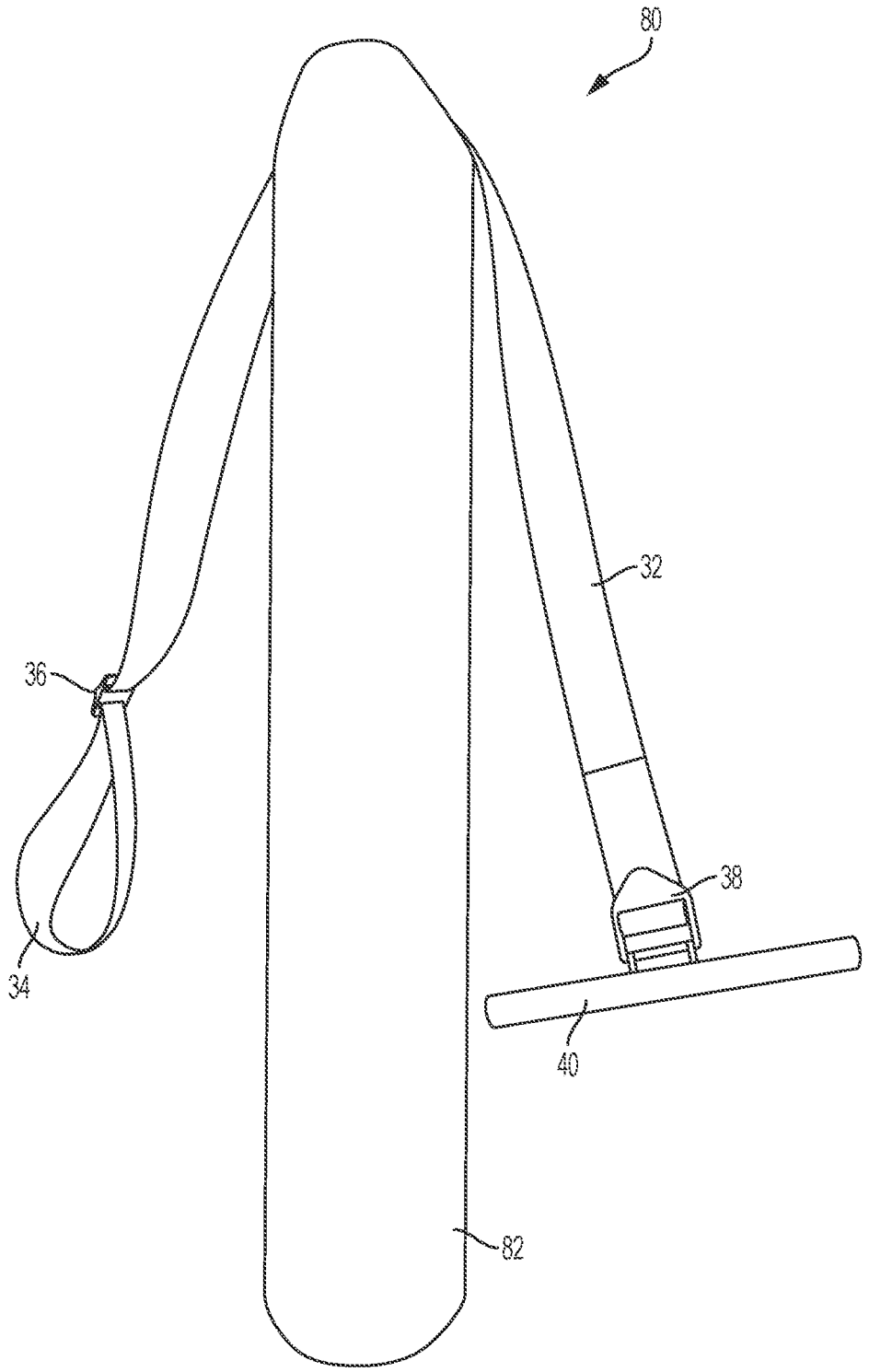
FIG. 17 depicts a top view of an alternative athletic training apparatus.

FIG. 17 depicts alternate athletic training apparatus 80, which shares the majority of components present in athletic training apparatus 30 including strap 32, handle slide fastener 38, handle 40 and loop slide fastener 36. Athletic training apparatus 80 comprises a generally cylindrical foam roller 82 comprising a first end slidably mounted to strap 32 and a second end configured to contact hip portion 26 of user 20. In an alternative embodiment, a cap with a friction element is coupled to the first end of foam roller 82 to engage with strap 32. Athletic training apparatus 80 is operated in substantially the same manner as athletic training apparatus 30.

It shall be appreciated that the components of the athletic training apparatuses described in several embodiments herein may comprise any alternative known materials in the field and be of any color, size and/or dimensions. It shall be appreciated that the components of the athletic training apparatuses described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. An athletic training apparatus for use to facilitate a stretch of a hamstring muscle of a user in a supine position with reduced effort, the training apparatus configured to engage with a foot, hand and hip region of the user and apply a counterforce at the hip region during the stretch to maintain a neutral spine of the user and prevent posterior pelvic tilt, the athletic training apparatus comprising:

a strap comprising a first end portion and a second end portion, the first end portion of the strap comprising a loop configured to engage the foot of the user, the second end portion of the strap configured to engage the hand of the user;

a strut comprising a first end slidably mounted to an intermediate portion of the strap and a second end configured to contact the hip region of the user; and a pad member rotatably mounted to the second end of the strut and configured to contact the hip region of the user;

wherein the apparatus is configured to maneuver to an operational position with the first and second end portions of the strap configured to engage the foot and hand and the second end of the strut configured to contact the hip region of the user when in the supine position, so that a pulling force applied to the second end portion of the strap permits the loop of the strap to raise the foot to a generally upright position, thereby stretching the hamstring muscle of the user, wherein the second end of the strut is configured to apply the counterforce to the hip region of the user during application of the pulling force at the second end portion of the strap to maintain the neutral spine of the user.

2. The athletic training apparatus of claim 1, wherein the pad member comprises a concave surface configured to conform to the hip region of the user.

3. The athletic training apparatus of claim 2, wherein the pad member is configured to rotate within the approximate range of 15 degrees to 360 degrees in a clockwise direction and 15 degrees to 360 degrees in a counterclockwise direction.

4. The athletic training apparatus of claim 3, wherein the first end of the strut comprises a connection member comprising a slot configured to permit the intermediate portion of the strap to pass therethrough.

5. The athletic training apparatus of claim 4, wherein the slot comprises a pathway comprising a shape selected from the group consisting of a linear shape, generally V-shape and generally U-shape.

6. The athletic training apparatus of claim 5, further comprising one or more friction members coupled to an interior wall of the slot and configured to contact the intermediate portion of the strap.

7. The athletic training apparatus of claim 6, wherein the one or more friction members are selected from the group consisting of tape, ridges, protrusions, teeth and screws.

8. The athletic training apparatus of claim 7, wherein the strut is collapsible.

9. The athletic training apparatus of claim 8, wherein the strut is configured to adjust to vary a length of the strut within an approximate range of 28" 40".

10. The athletic training apparatus of claim 9, further comprising a slide fastener coupled to the strap to form the loop in the first end portion of the strap.

11. The athletic training apparatus of claim 10, wherein the slide fastener is configured to permit variations in size of the loop in the strap.

12. A method for stretching a hamstring muscle of a user in a supine position with reduced effort, the method comprising:

providing an athletic training apparatus, the apparatus comprising:

a strap comprising a first end portion with a loop and a second end portion; and a strut comprising a first end slidably mounted to an intermediate portion of the strap and a second end;

engaging the loop of the first end portion of the strap with a foot of the user;

engaging the second end portion of the strap with a hand of the user;

positioning the second end of the strut to contact a hip region of the user; and applying a pulling force to the second end portion of the strap when the user is in the supine position to permit the loop of the strap to raise the foot of the user to a generally upright position.

* * * * *